US011173083B2

(12) United States Patent
Zhang

(10) Patent No.: US 11,173,083 B2
(45) Date of Patent: Nov. 16, 2021

(54) CHAIR

(71) Applicant: Wonderland Switzerland AG, Steinhausen (CH)

(72) Inventor: Xiaojian Zhang, Hong Kong (CN)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 16/947,163

(22) Filed: Jul. 21, 2020

(65) Prior Publication Data

US 2021/0196540 A1 Jul. 1, 2021

(30) Foreign Application Priority Data

Dec. 25, 2019 (CN) ..... 201922377850.4

(51) Int. Cl.

| | |
|---|---|
| ***A47C 7/50*** | (2006.01) |
| ***A61G 5/12*** | (2006.01) |
| ***A61G 5/10*** | (2006.01) |
| ***A47C 7/46*** | (2006.01) |

(52) U.S. Cl.

CPC ..... *A61G 5/128* (2016.11); *A47C 7/462* (2013.01); *A47C 7/5066* (2018.08); *A61G 5/1067* (2013.01); *A61G 2200/34* (2013.01)

(58) Field of Classification Search

CPC .... A47C 7/462; A47C 7/5066; A61G 5/1067; A61G 5/128; A61G 2200/34

USPC ..... 297/423.23, 423.24, 423.26, 423.3

See application file for complete search history.

(56) References Cited

U.S. PATENT DOCUMENTS 181,137 A * 8/1876 Brintnall ..... A61G 5/12 297/423.26
357,955 A * 2/1887 Ferst ..... A61G 5/006 297/70
636,725 A * 11/1899 Healy ..... A47C 7/506 297/423.24
639,076 A * 12/1899 May ..... A47C 1/026 297/370
644,933 A * 3/1900 McCall ..... A47C 1/026 297/423.24 X
648,110 A * 4/1900 McCall ..... A47C 7/506 297/423.24
683,032 A * 9/1901 Franklin ..... A47C 1/026 297/423.23 X (Continued)

FOREIGN PATENT DOCUMENTS

CN 210301466 U 4/2020
EP 2113234 A 11/2009

(Continued)

OTHER PUBLICATIONS

Search Report issued to United Kingdom counterpart application No. 2011502.8 by the U.K. Intellectual Property Office dated Jan. 25, 2021.

*Primary Examiner* — Rodney B White
(74) *Attorney, Agent, or Firm* — TraskBritt

(57) ABSTRACT

A chair includes a frame unit including a seat frame, a leg rest that is pivotally mounted to the seat frame, and a rest adjusting mechanism that is connected between the leg rest and the seat frame. The rest adjusting mechanism is convertible between an unlocked state, where the leg rest is permitted to pivot relative to the seat frame, and a locked state, where the leg rest is not permitted to pivot relative to the seat frame.

11 Claims, 11 Drawing Sheets

(56) References Cited

U.S. PATENT DOCUMENTS 2,605,813 A * 8/1952 Seitz ..... B60N 2/04 297/423.26 X
3,858,938 A * 1/1975 Kristensson ..... A61G 5/125 297/423.26 X
3,861,745 A * 1/1975 Forrest ..... A61G 5/006 297/423.26
4,643,446 A * 2/1987 Murphy ..... A61G 3/06 180/11
4,945,582 A * 8/1990 Hayton ..... A61G 5/006 297/423.26
5,328,247 A * 7/1994 Lovins ..... A47C 7/506 297/423.3
5,342,112 A * 8/1994 Padovan ..... A47C 7/506 297/423.26 X
5,505,519 A * 4/1996 Natt ..... B60N 2/28 297/423.26 X
5,556,157 A * 9/1996 Wempe ..... A61G 5/006 297/423.26
5,560,681 A * 10/1996 Dixon ..... B64D 11/0643 297/423.26 X
5,597,210 A * 1/1997 Pickard ..... A47C 7/506 297/423.3 X
5,673,967 A * 10/1997 Wempe ..... A61G 5/006 297/423.26
6,086,086 A * 7/2000 Hanson ..... A61G 5/0891 280/650
6,382,727 B1 * 5/2002 Pickard ..... A47C 7/506 297/423.3 X
6,517,160 B2 * 2/2003 Marcantoni ..... A47C 7/506 297/423.36
6,612,650 B1 * 9/2003 Ambrosio ..... A47C 1/035 297/423.26 X
6,692,068 B1 * 2/2004 Tang ..... A47C 1/035 297/423.26 X
6,692,078 B2 * 2/2004 Pham ..... A47C 1/0342 297/423.19
6,715,783 B1 * 4/2004 Hanson ..... B62B 7/10 280/47.38
8,567,866 B2 * 10/2013 Carimati Di Carimate ..... B62B 9/14 297/423.26 X
2010/0007189 A1 * 1/2010 Sagstuen ..... A61G 5/128 297/423.3

FOREIGN PATENT DOCUMENTS

GB 2089204 A 6/1982
SE 508092 C2 8/1998

* cited by examiner

CHAIR

CROSS-REFERENCE TO RELATED APPLICATION

This application claims the benefit of the priority date of Chinese Utility Model Patent Application No. 201922377850.4, filed on Dec. 25, 2019.

FIELD

The disclosure relates to a chair, more particularly to a chair with an adjustable leg rest.

BACKGROUND

Those with impaired physical mobility may need to make use of tools such as walkers, walking sticks and wheelchairs in order to move or be moved. A conventional wheelchair supports an assisted person in a sitting position and includes a seat and a leg rest mounted to the seat for the assisted person to rest their legs thereagainst. However, the leg rest of the conventional wheelchair is not movable relative to the seat to adjust an angle between the seat and the leg rest. Thus, the conventional wheelchair cannot achieve support for a variety of positions where the legs of the assisted person are bent at different angles.

SUMMARY

Therefore, the object of the disclosure is to provide a chair which can alleviate the drawback of the prior art.

According to the disclosure, a chair includes a frame unit including a seat frame, a leg rest that is pivotally mounted to the seat frame, and a rest adjusting mechanism that is connected between the leg rest and the seat frame.

The rest adjusting mechanism is convertible between an unlocked state, where the leg rest is permitted to pivot relative to the seat frame, and a locked state, where the leg rest is not permitted to pivot relative to the seat frame.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
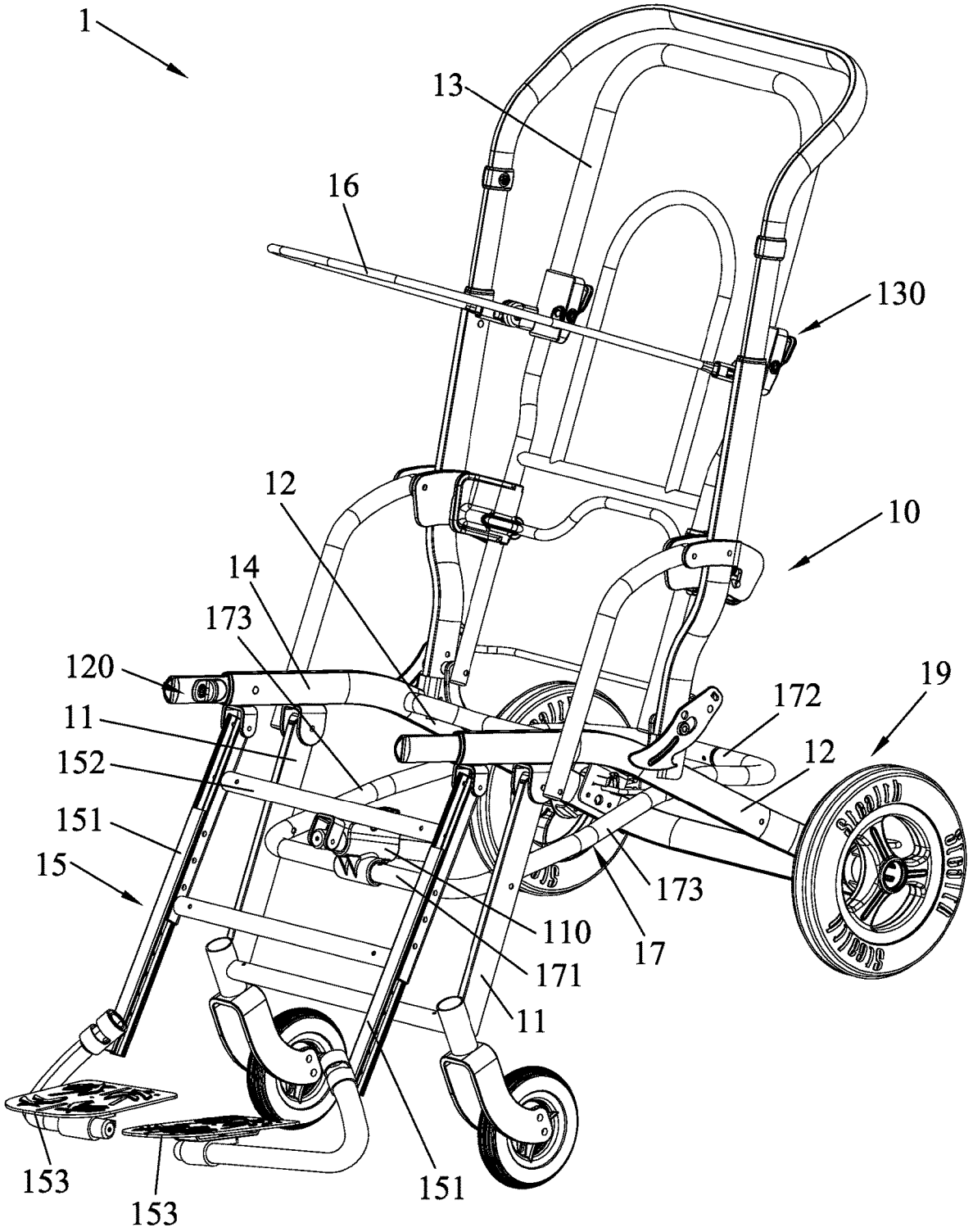
FIG. 1 is a schematic perspective view of an embodiment of a chair according to the disclosure.

Referring to FIG. 1, an embodiment of a chair 1 according to the disclosure includes a frame unit 10 and a wheels unit 19. In this embodiment, the chair 1 is exemplified as a wheelchair. In other embodiments, the chair 1 may be exemplified as other chairs, such as a stroller, a car seat, or a high chair, and the wheels unit 19 may be omitted. The frame unit 10 includes two front legs 11, two rear legs 12, a back rest 13, a seat frame 14, a leg rest 15 that is pivotally mounted to the seat frame 14, and a rest adjusting mechanism 110 that is connected between the leg rest 15 and the seat frame 14. The rest adjusting mechanism 110 is convertible between an unlocked state, where the leg rest 15 is permitted to pivot relative to the seat frame 14, and a locked state, where the leg rest 15 is not permitted to pivot relative to the seat frame 14.

In this embodiment, the frame unit 10 further includes a seat adjusting mechanism 120, a canopy frame 16 mounted to the back rest 13, and a canopy adjusting mechanism 130 mounted to the back rest 13. The canopy adjusting mechanism 130 is convertible between an unfastened state, where a height of the canopy frame 16 relative to the back rest 13 is permitted to be adjusted, and a fastened state, where the canopy frame 16 is fixed to the back rest 13.

Referring to FIG. 1, the leg rest 15 has two rest rods 151, a horizontal rod 152 interconnecting the rest rods 151, and a pair of foot rests 153 connected respectively to two ends of the rest rods 151. The front legs 11 are connected pivotally to the seat frame 14 and proximate to the leg rest 15. The rear legs 12 are disposed at a rear side of the front legs 11 and connected to the seat frame 14. The frame unit 10 further includes a bottom frame 17 connected to the front and rear legs 11, 12. The bottom frame 17 is substantially rectangular and has a front rod 171 proximate to the front legs 11, a rear rod 172 proximate to the rear legs 12, and two side rods 173 interconnecting the front and rear rods 171, 172. The rest adjusting mechanism 110 is mounted between the front rod 171 and the horizontal rod 152 of the leg rest 15.

Figure 2:
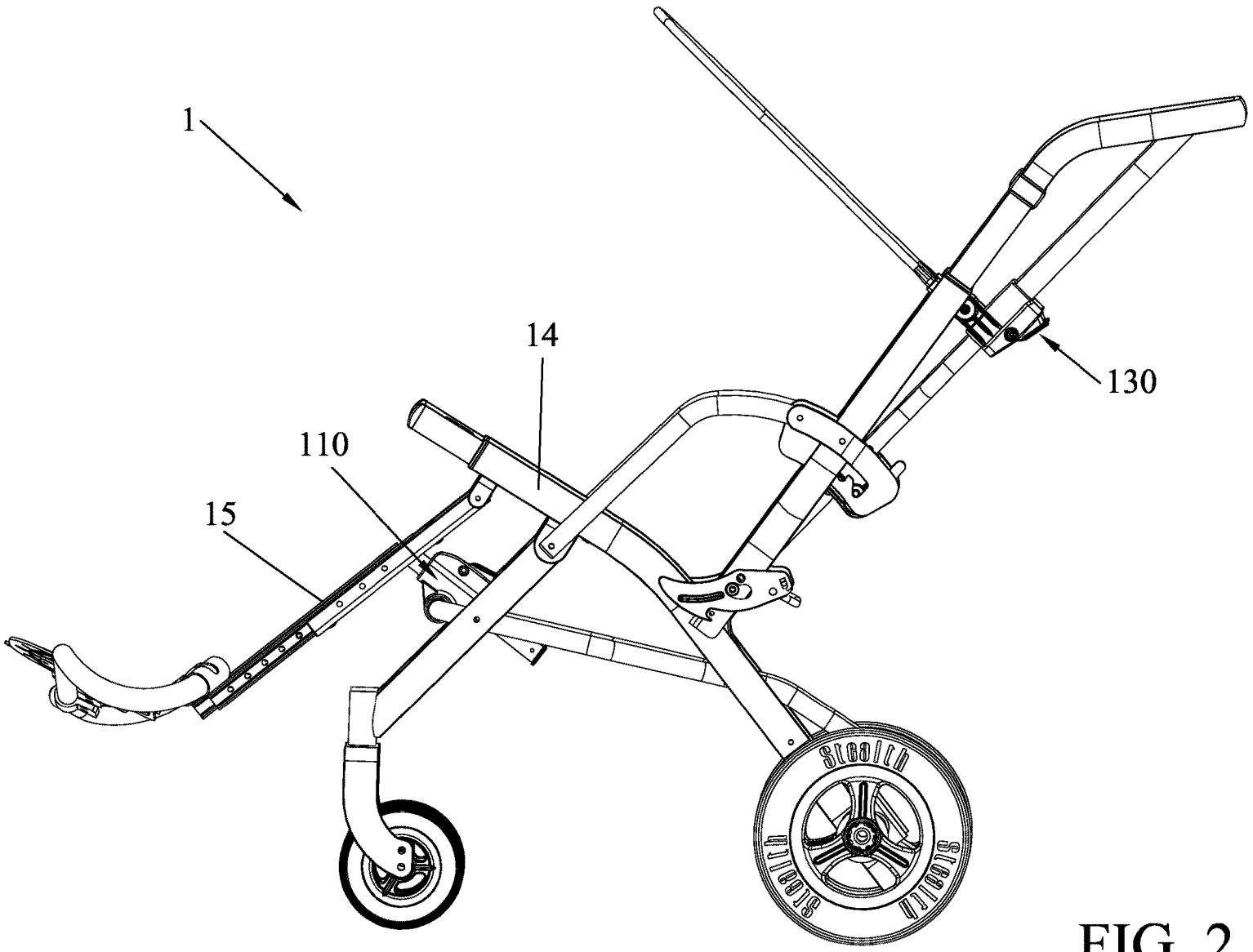
FIG. 2 is a schematic side view of the embodiment illustrating a leg rest at one of a plurality of predetermined positions.
Figure 3:
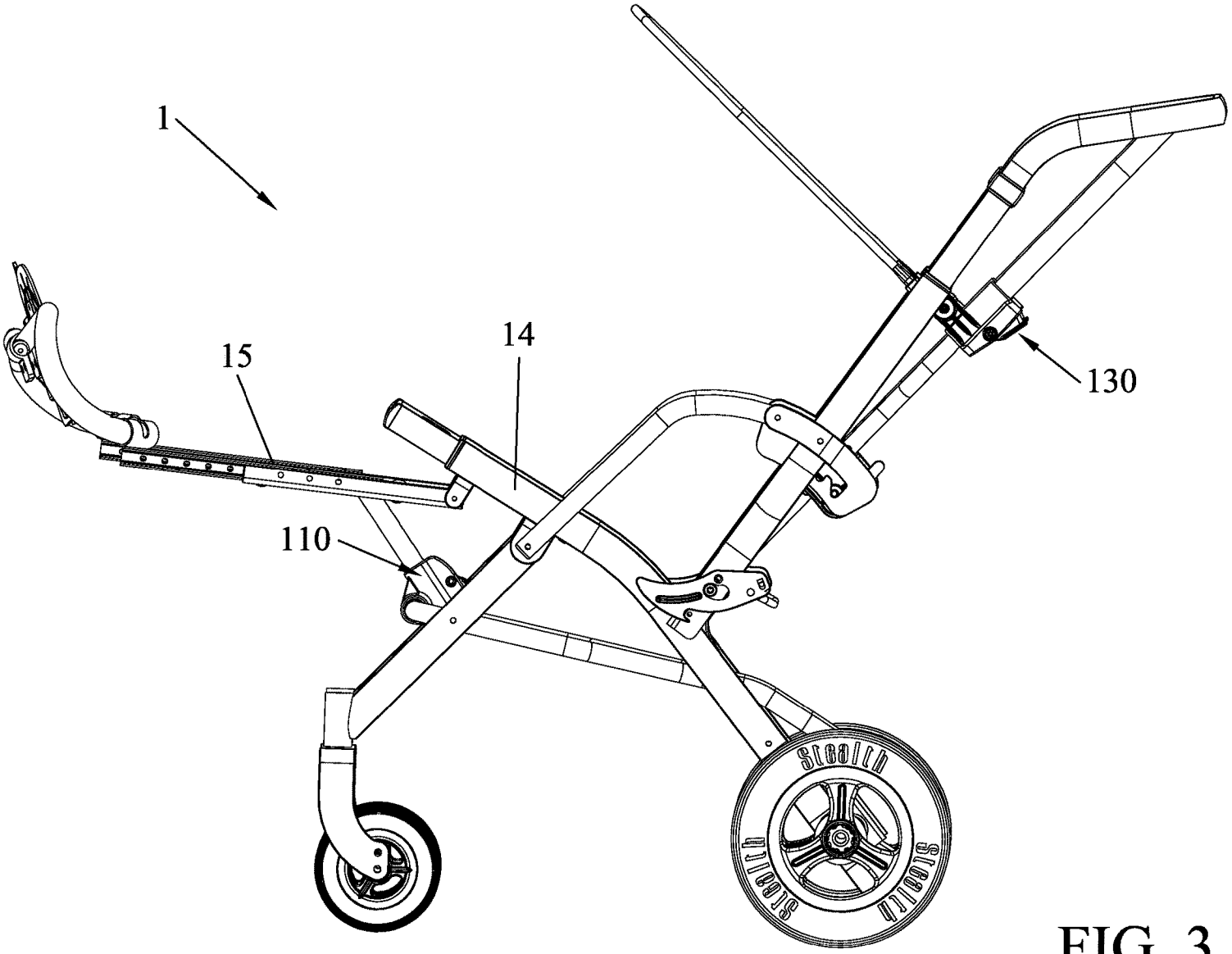
FIG. 3 is a view similar to FIG. 2 but illustrating the leg rest at another one of the predetermined positions.
Figure 4:
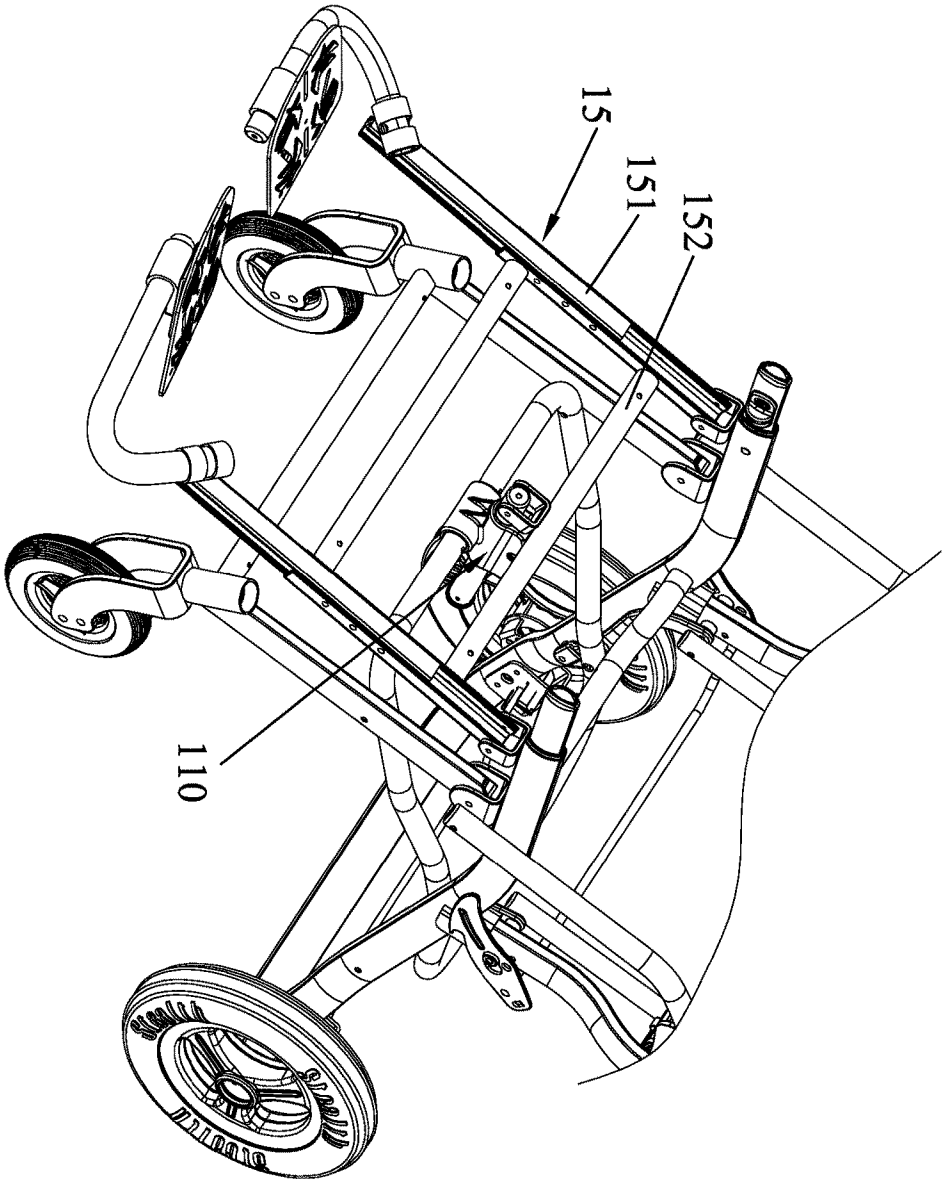
FIG. 4 is a fragmentary perspective view of the embodiment.
Figure 5:
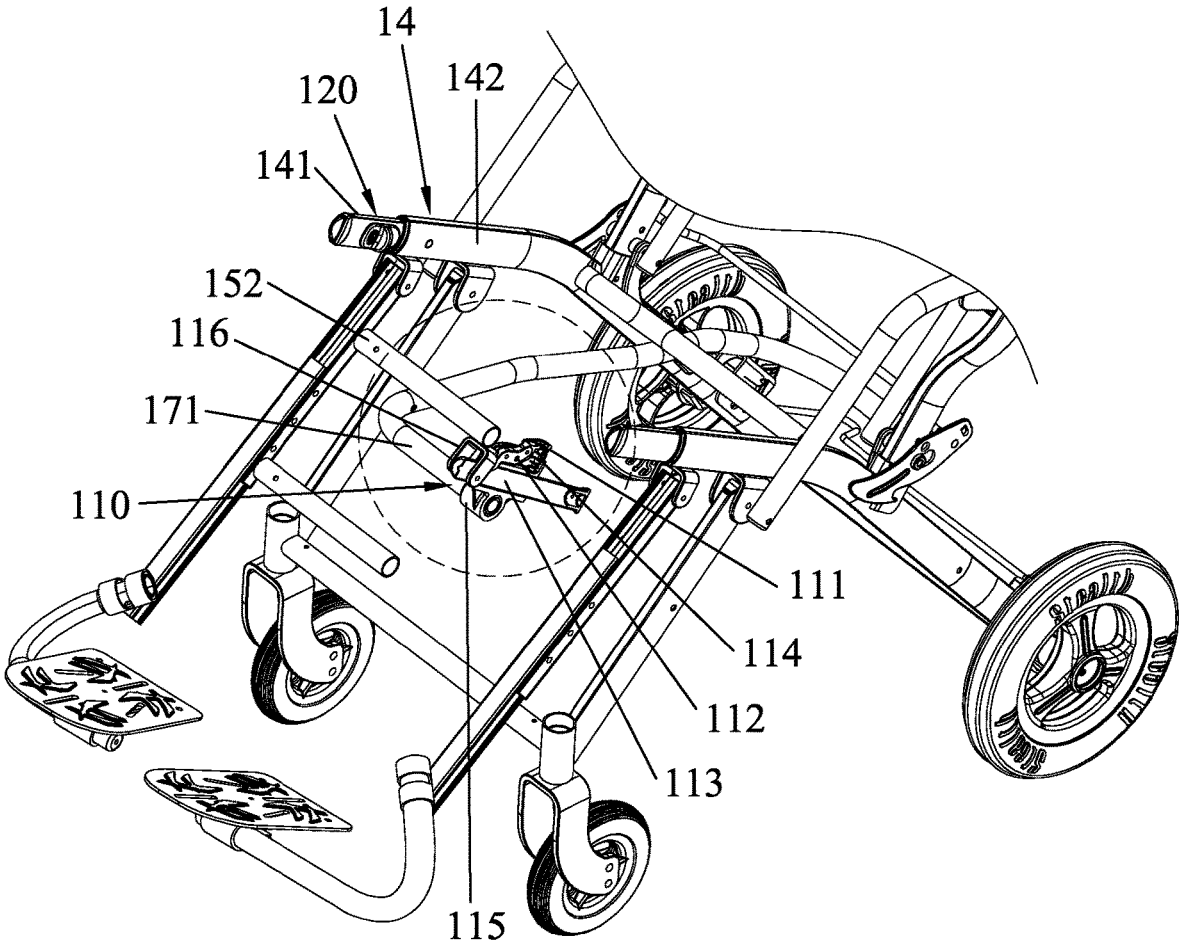
FIG. 5 is a fragmentary cutaway view of the embodiment.
Figure 6:
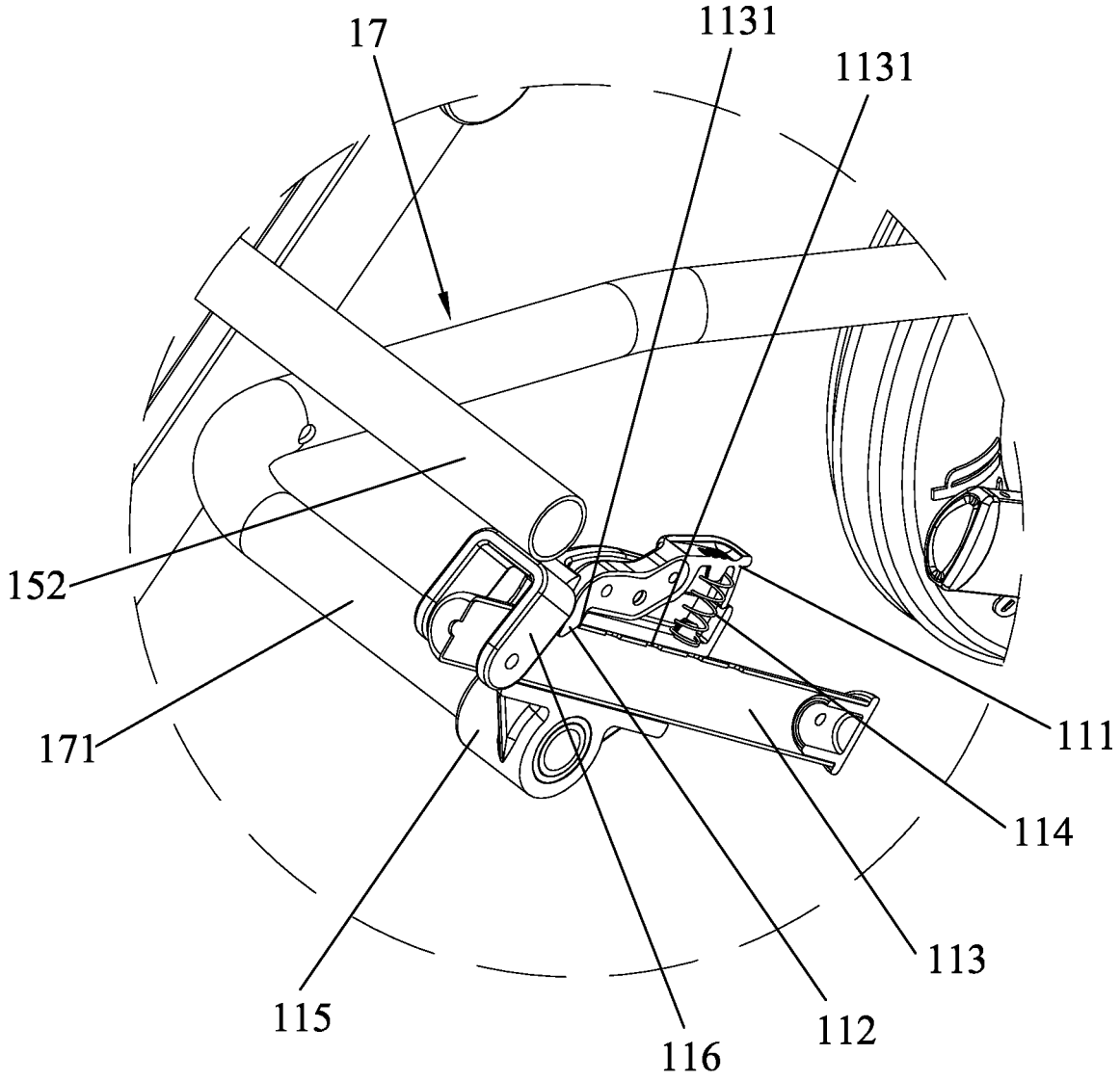
FIG. 6 is a fragmentary magnified view of FIG. 5.
Figure 7:
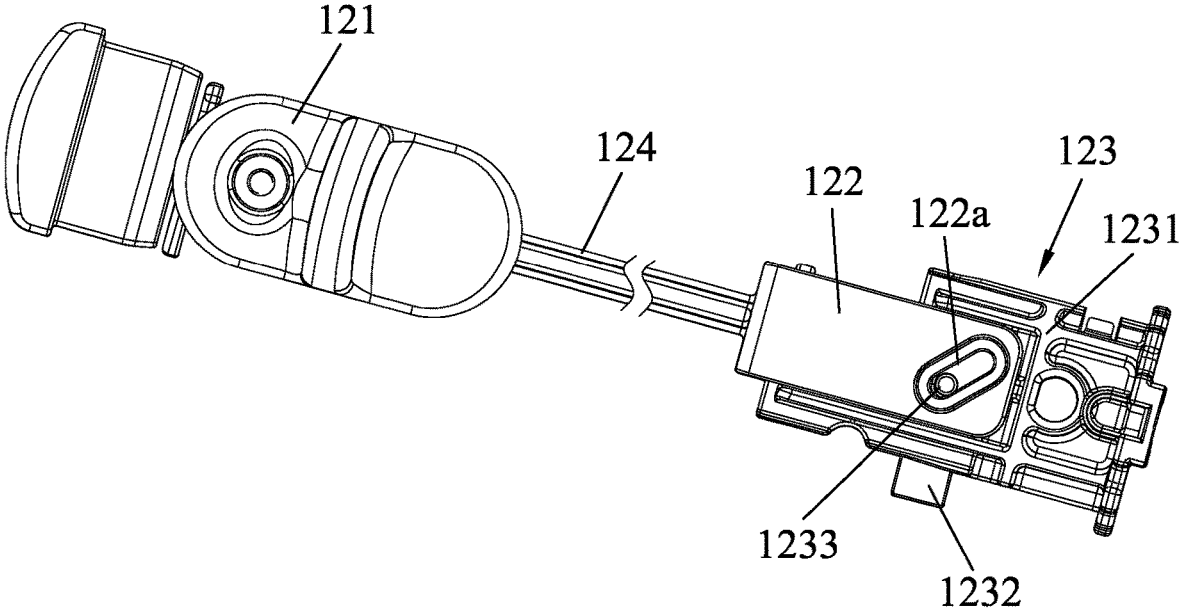
FIG. 7 is a fragmentary view of a seat adjusting mechanism of the embodiment in an engaging state.
Figure 8:
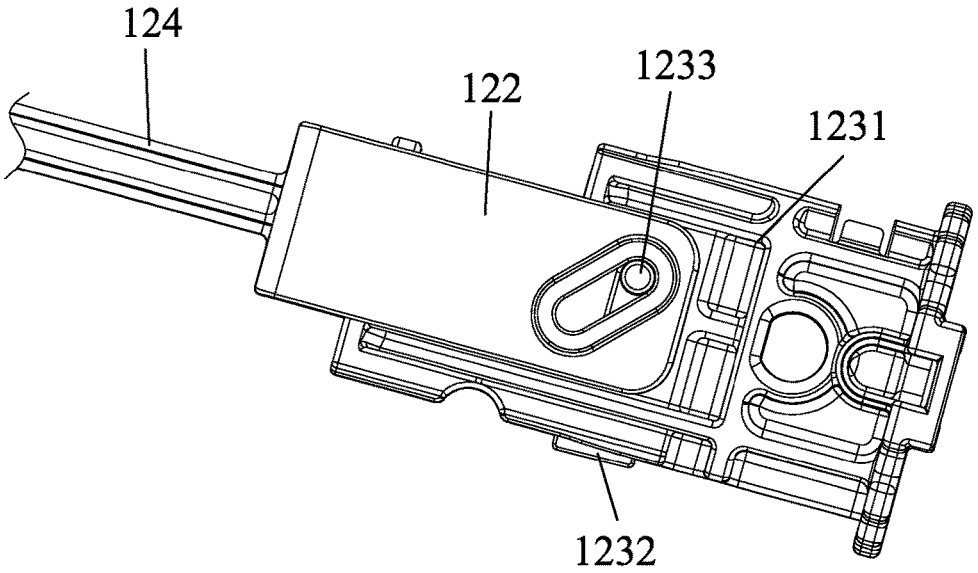
FIG. 8 is a fragmentary view of the seat adjusting mechanism in a disengaging state.
Figure 9:
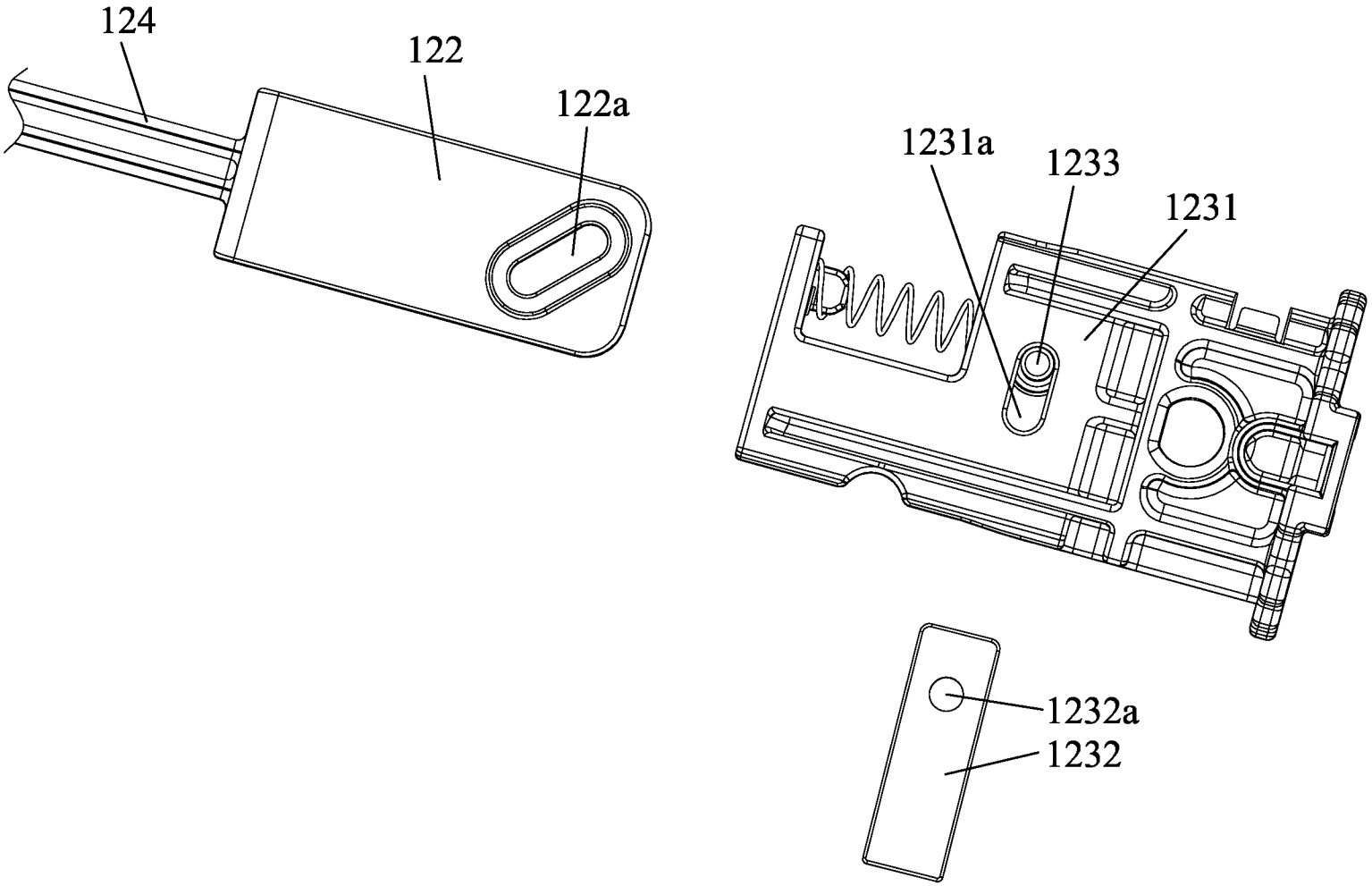
FIG. 9 is a partly exploded and fragmentary view of the seat adjusting mechanism.

Referring to FIGS. 4, 5 and 6, the rest adjusting mechanism 110 includes an operating member 111, a locking member 112, a positioning rod 113, a biasing member 114, and a mounting casing 115. Specifically, the mounting casing 115 is mounted to a center portion of the front rod 171 of the bottom frame 17, and surrounds the positioning rod 113. The operating member 111 is connected to the locking member 112 and pivotally connected to the mounting casing 115. The biasing member 114 is connected between the operating member 111 and the mounting casing 115. In this embodiment, the operating member 111 and the locking member 112 are molded as one piece, with the locking member 112 formed on one end of the operating member 111. The positioning rod 113 has a plurality of engaging holes 1131 and is co-movably and pivotally connected to the horizontal rod 152 of the leg rest 15. Specifically, the positioning rod 113 has one end pivotally connected to a hinge portion 116 mounted fixedly to the horizontal rod 152. When the rest adjusting mechanism 110 is in the locked state, the locking member 112 engages one of the engaging holes 1131 so that the positioning rod 113 is not permitted to move relative to the locking member 112. When the rest adjusting mechanism 110 is in the locked state, the operating member 111 is operable against a resilient force of the biasing member 114 to disengage the locking member 112 from the one of the engaging holes 1131 to convert the rest adjusting mechanism 110 to the unlocked state to permit movement of the positioning rod 113 relative to the locking member 112 and to thereby permit pivot movement of the leg rest 15 relative to the seat frame 14. As such, as shown in FIGS. 2 and 3, an angle of tilt of the leg rest 15 relative to the seat frame 14 may be adjusted. In this embodiment, the leg rest 15 may be secured at a plurality of predetermined angles corresponding respectively to the engaging holes 1131. In certain embodiments, the number of the engaging holes 1131, and thus of the predetermined angles, may be between 3 and 5.

Referring to FIG. 5, the seat frame 14 includes inner and outer tubes 141, 142 coupled telescopically to each other, and the seat adjusting mechanism 120 is mounted to the inner and outer tubes 141, 142 and convertible between an engaging state, where movement between the inner and outer tubes 141, 142 is not allowed, and a disengaging state, where movement between the inner and outer tubes 141, 142 is allowed. Further referring to FIGS. 7, 8, 9 and 12, the seat adjusting mechanism 120 includes an engaging member 1420 that is disposed on the outer tube 142, a push knob 121 mounted to the inner tube 141, a driving block 122, a locking set 123, and a connecting rod 124 interconnecting the push knob 121 and the driving block 122. The locking set 123 is connected to the inner tube 141 and engages the engaging member 1420. The driving block 122 is connected to the locking set 123, and is operable for disengaging the locking set 123 from the engaging member 1420 to convert the seat adjusting mechanism 120 to the disengaging state.

Specifically, the locking set 123 includes a fixed member 1231 mounted to the inner tube 141, a locking block 1232 sandwiched between the driving block 122 and the fixed member 1231, and a locking pin 1233. The fixed member 1231 is formed with a vertical groove 1231*a*, the locking block 1232 is formed with a through hole 1232*a*, and the driving block 122 is formed with a guiding groove 122*a* extending obliquely to the vertical groove 1231*a*. The locking pin 1233 extends sequentially through the guiding groove 122*a* of the driving block 122, the through hole 1232*a* of the locking block 1232, and the vertical groove 1231*a* of the fixed member 1231. The locking pin 1233 is movable relative to the fixed member 1231 and the driving block 122 due to being movably retained in both the guiding groove 122*a* and the vertical groove 1231*a*. The locking block 1232 is connected co-movably to the locking pin 1233. The engaging member 1420 has a plurality of locking holes 1421 formed in the outer tube 142, and the locking block 1232 engages one of the locking holes 1421 of the outer tube 142 when the seat adjusting mechanism 120 is in the engaging state. When the seat adjusting mechanism 120 is in the engaging state, the driving block 122 is movable relative to the fixed member 1231 to move the locking pin 1233 under guidance of the guiding groove 122*a* and the vertical groove 1231*a*, thereby driving the locking block 1232 to be disengaged from one of the locking holes 1421 and converting the seat adjusting mechanism 120 to the disengaging state.

Specifically, the push knob 121 may be actuated to move the driving block 122 away from the locking set 123 via the connecting rod 124. Under guidance of the guiding groove 122*a* and the vertical groove 1231*a*, the locking pin 1233 then moves away from the locking holes 1421, which drives the locking block 1232 to retract between the driving block 122 and the fixed member 1231 and disengage from one of the locking holes 1421 to convert the seat adjusting mechanism 120 to the disengaging state. Once the inner and outer tubes 141, 142 have been adjusted to a desired configuration, the push knob 121 may be released so that the driving block 122 may move back toward the fixed member 1231 to thereby drive the locking block 1232 to protrude from between the fixed member 1231 and the driving block 122 to thereby engage with one of the locking holes 1421 and lock the outer tube 142 relative to the inner tube 141.

Figure 10:
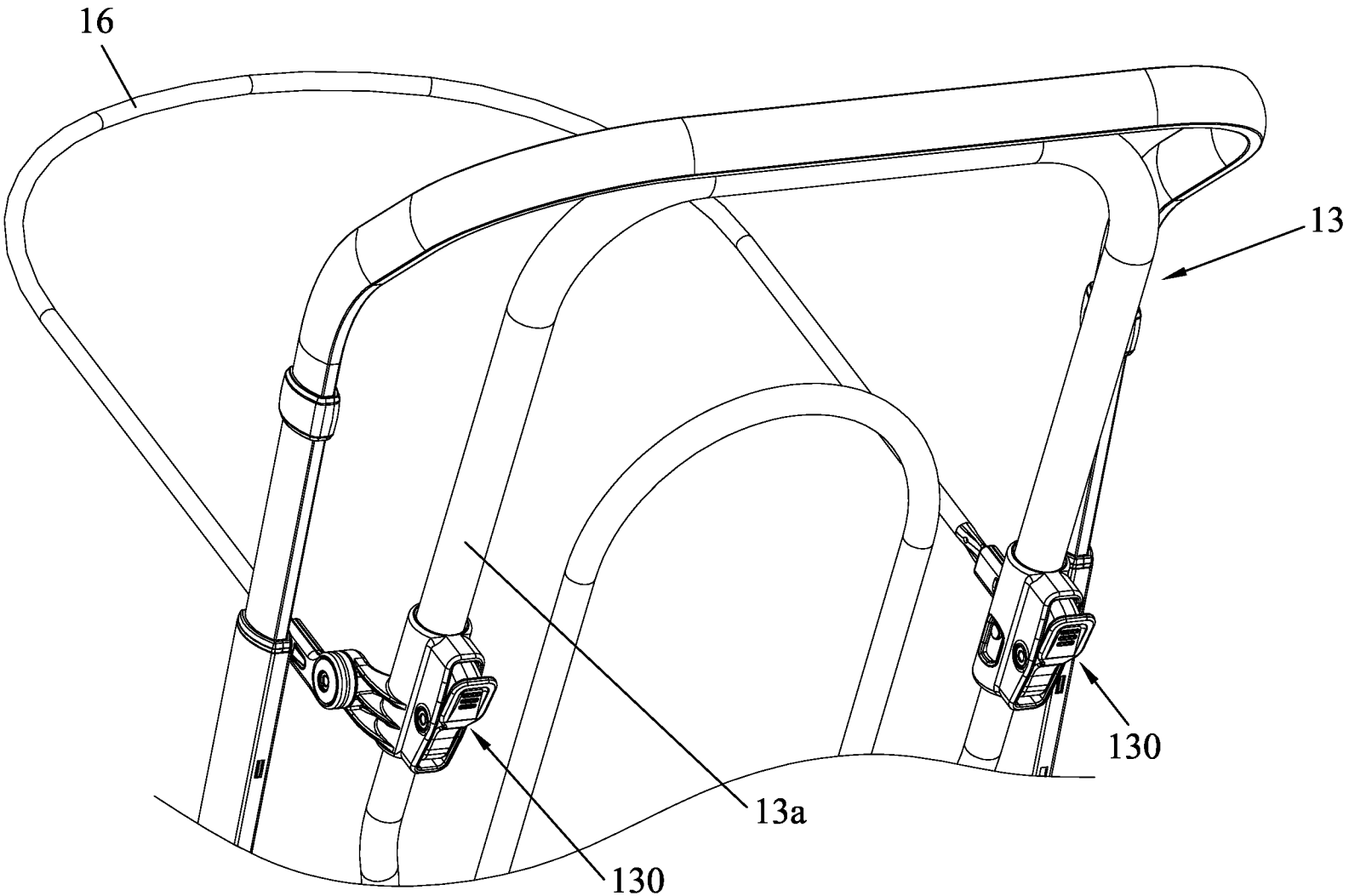
FIG. 10 is a fragmentary perspective view of the embodiment.
Figure 11:
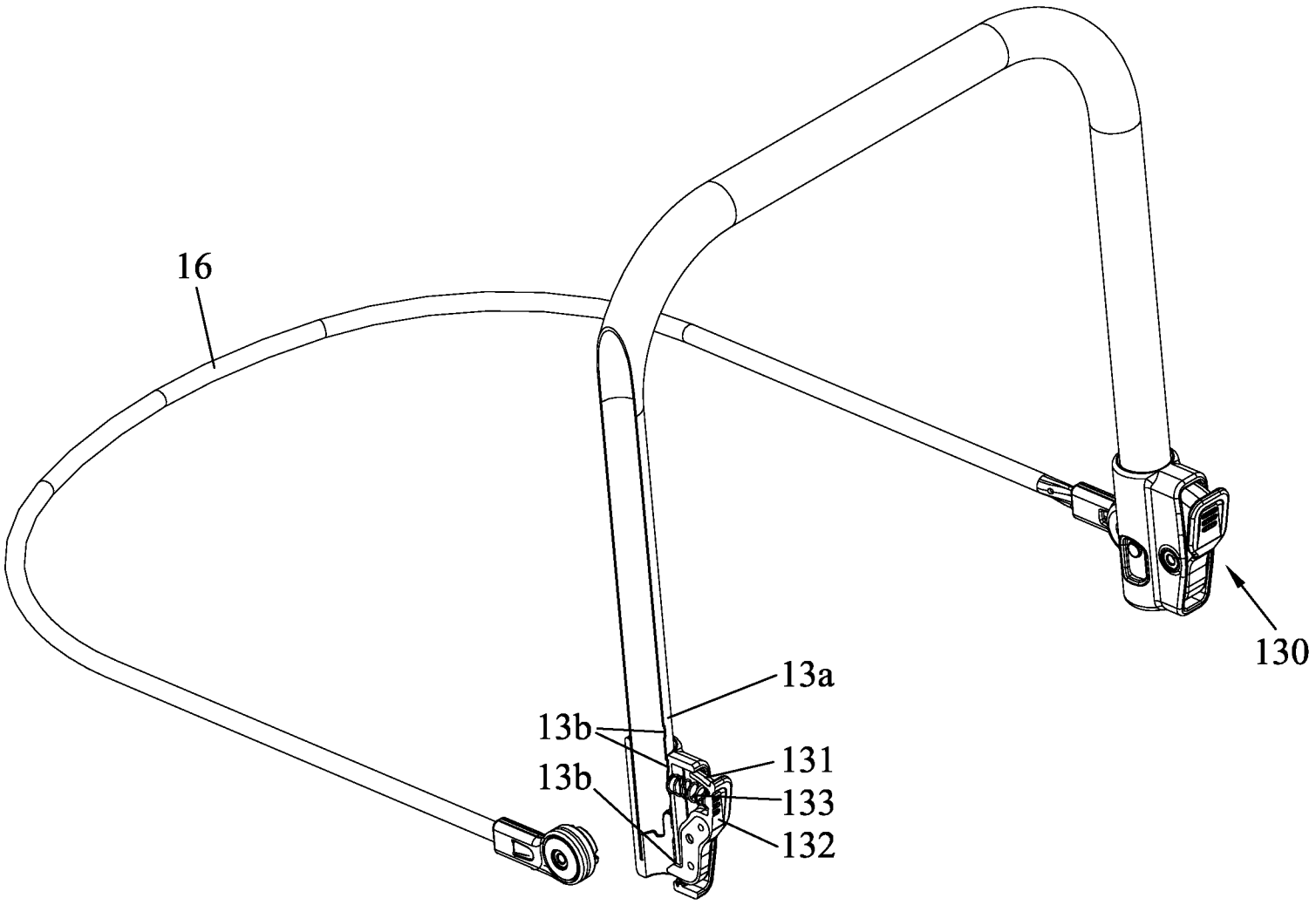
FIG. 11 is a cutaway view of a rest rod, a canopy frame and a canopy adjusting mechanism of the embodiment.
Figure 12:
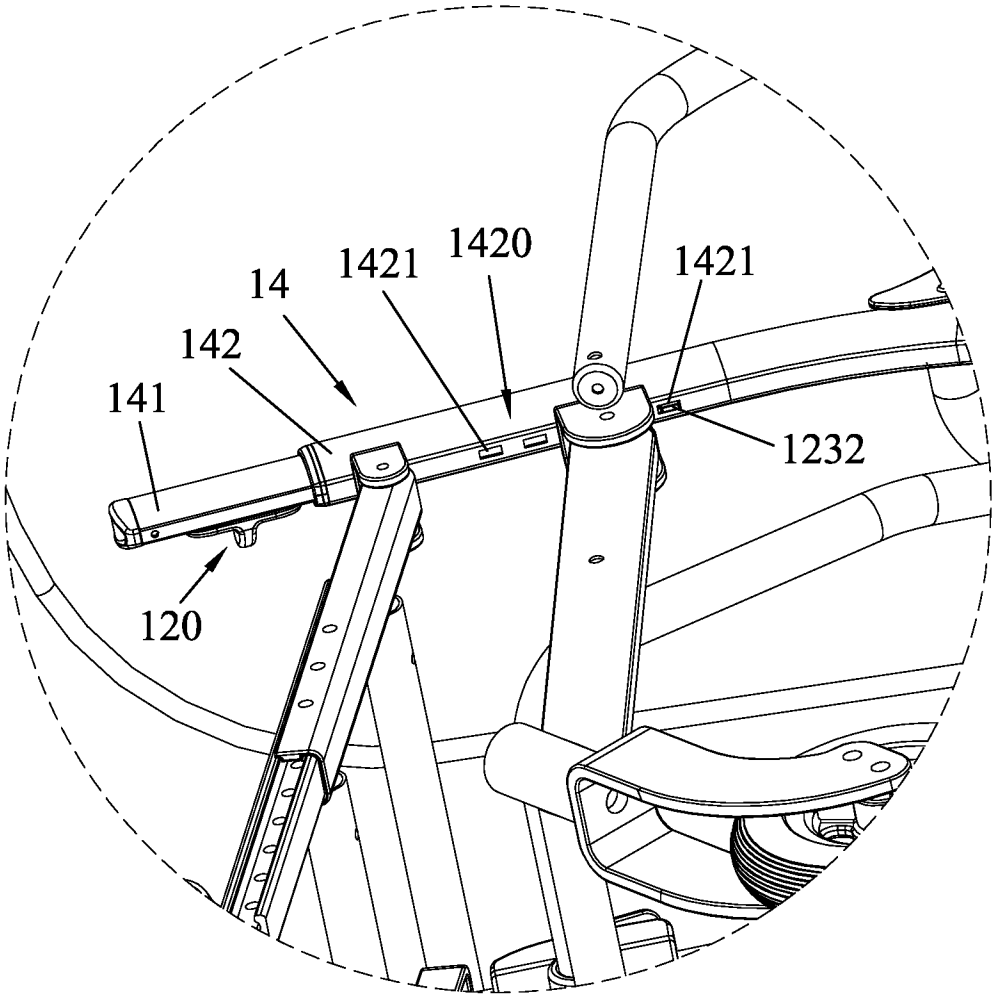
FIG. 12 is a fragmentary magnified view of the embodiment.

Referring to FIGS. 10 and 11, the back rest 13 includes a rest rod 13*a*, and the canopy frame 16 is mounted to the back rest 13 via the canopy adjusting mechanism 130. In this embodiment, the canopy adjusting mechanism 130 is two in number, but only one canopy adjusting mechanism. 130 is discussed hereinafter for conciseness of this disclosure. The canopy adjusting mechanism 130 includes a surrounding base 131 surrounding and slidable along the rest rod 13*a*, an actuating member 132 mounted on the surrounding base 131, a resilient member 133 disposed between the surrounding base 131 and the actuating member 132, and a plurality of positioning holes 13*b* formed on the rest rod 13*a* of the back rest 13. When the canopy adjusting mechanism 130 is in the fastened state, the actuating member 132 engages one of the positioning holes 13*b*, and is operable against a resilient force of the resilient member 133 to be disengaged from the one of the positioning holes 13*b* to convert the canopy adjusting mechanism 130 to the unfastened state, thereby permitting movement of the canopy frame 16 relative to the rest rod 13*a*.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A chair comprising a frame unit including:

a seat frame, a leg rest that is pivotally mounted to said seat frame, and a rest adjusting mechanism that is connected between said leg rest and said seat frame;

wherein said rest adjusting mechanism is convertible between an unlocked state, where said leg rest is permitted to pivot relative to said seat frame, and a locked state, where said leg rest is not permitted to pivot relative to said seat frame; and wherein said frame unit further includes:

two from legs connected pivotally to said seat frame and proximate to said leg rest;

two rear legs disposed at a rear side of the said front legs and connected to said seat frame; and a bottom frame connected to said front and rear legs, and having a front rod that is proximate to said front legs, said rest adjusting mechanism being mounted between said front rod and said leg rest.

2. The chair as claimed in claim 1, wherein:

said rest adjusting mechanism includes an operating member, a locking member, and a positioning rod that has a plurality of engaging holes and that is co-movably connected to said leg rest;

when said rest adjusting mechanism is in the locked state, said locking member engages one of said engaging holes so that said positioning rod is not permitted to move relative to said locking member; and when said rest adjusting mechanism is in the locked state, said operating member is operable to disengage said locking member from the one of said engaging holes to convert said rest adjusting mechanism to the unlocked state to permit movement of said positioning rod relative to said locking member and to thereby permit pivot movement of said leg rest relative to said seat frame.

3. The chair as claimed in claim 2, wherein said operating member and said locking member are molded as one piece.

4. The chair as claimed in claim 2, wherein said rest adjusting mechanism further includes a mounting casing mounted to said front rod of said bottom frame and surrounding said positioning rod, said operating member being pivotally connected to said mounting casing.

5. The chair as claimed in claim 4, wherein:

said rest adjusting mechanism further includes a biasing member connected between said operating member and said mounting casing; and when said rest adjusting mechanism is in the locked state, said operating member is operable against a resilient force of said biasing member to disengage said locking member from the one of said engaging holes to convert said rest adjusting mechanism to the unlocked state.

6. The chair as claimed in claim 1, wherein said seat frame includes inner and outer tubes coupled telescopically to each other, and a seat adjusting mechanism mounted to said inner tube and said outer tube, and convertible between an engaging state, where movement between said inner and outer tubes is not allowed, and a disengaging state, where movement between said inner and outer tubes is allowed.

7. The chair as claimed in claim 6, wherein said seat adjusting mechanism includes an engaging member that is disposed on said outer tube, a locking set that is connected to said inner tube and that engages said engaging member, and a driving block that is connected to said locking set, and that is operable for disengaging said locking set from said engaging member to convert said seat adjusting mechanism to the disengaging state.

8. The chair as claimed in claim 7, wherein:

said driving block is formed with a guiding groove;

said engaging member has a plurality of locking holes formed in said outer tube;

said locking set includes a fixed member mounted to said inner tube, a locking block sandwiched between said driving block and said fixed member and engaging one of said locking holes of said outer tube when said seat adjusting mechanism is in the engaging state, and a locking pin extending sequentially through said guiding groove of said driving block, said locking block, and said fixed member, said locking pin being movable relative to said driving block and said fixed member, said locking block being connected co-movably to said locking pin; and when said seat adjusting mechanism is in the engaging state, said driving block is movable relative to said fixed member to move said locking pin under guidance of said guiding groove, thereby driving said locking block to be disengaged from the one of said locking holes and converting said seat adjusting mechanism to the disengaging state.

9. The chair as claimed in claim 1, wherein said frame unit further includes a back rest, a canopy frame mounted to said back rest, and a canopy adjusting mechanism mounted to said back rest, said canopy adjusting mechanism being convertible between an unfastened state, where a height of said canopy frame relative to said back rest is permitted to be adjusted, and a fastened state, where said canopy frame is fixed to said back rest.

10. The chair as claimed in claim 9, wherein:

said back rest includes a rest rod;

said canopy adjusting mechanism includes a surrounding base that surrounds said rest rod and that is slidable along said rest rod, an actuating member that is mounted on said surrounding base, and a plurality of positioning holes formed on said rest rod of said back rest;

when said canopy adjusting mechanism is in the fastened state, said actuating member engages one of said positioning holes; and when said canopy adjusting mechanism is in the fastened state, said actuating member is operable to be disengaged from the one of said positioning holes to convert said canopy adjusting mechanism to the unfastened state, thereby permitting movement of said canopy frame relative to said rest rod.

11. The chair as claimed in claim 10, wherein:

said canopy adjusting mechanism further includes a resilient member disposed between said surrounding base and said actuating member; and when said canopy adjusting mechanism is at the fastened state, said actuating member is operable against a resilient force of said resilient member to be disengaged from the one of said positioning holes to convert said canopy adjusting mechanism to the unfastened state.

* * * * *